US006273687B1

(12) United States Patent
Nogimori et al.

(10) Patent No.: US 6,273,687 B1
(45) Date of Patent: Aug. 14, 2001

(54) MICROMACHINED PUMP APPARATUS

(75) Inventors: Wataru Nogimori; Yoshihiro Naruse, both of Aichi-ken; Kouichi Irisa, Tokyo; Shinji Ando, Chiba-ken, all of (JP)

(73) Assignee: Aisin Seiki Kabushiki Kaisha, Aichi-Ken (JP)

( * ) Notice: Subject to any disclaimer, the term of this patent is extended or adjusted under 35 U.S.C. 154(b) by 0 days.

(21) Appl. No.: 09/445,000

(22) Filed: Nov. 23, 1999

(30) Foreign Application Priority Data

Nov. 26, 1998 (JP) ..... 10-336012

(51) Int. Cl.[7] ..... F04B 17/00
(52) U.S. Cl. ..... 417/413.1; 435/286.5
(58) Field of Search ..... 417/322, 413.1; 250/289; 435/286.5

(56) References Cited

U.S. PATENT DOCUMENTS 4,636,149 * 1/1987 Brown ..... 417/322
5,499,909 3/1996 Yamada et al. ..... 417/384
5,659,171 * 8/1997 Young et al. ..... 250/289
5,725,363 * 3/1998 Bustgens et al. ..... 417/413.1
5,836,750 * 11/1998 Cabuz ..... 417/322
5,856,174 * 1/1999 Lipshutz et al. ..... 435/286.5
6,007,309 * 12/1999 Hartley ..... 417/322
6,116,863 * 9/2000 Ahn et al. ..... 417/322

FOREIGN PATENT DOCUMENTS 7-139471 5/1995 (JP) .
10-159811 6/1998 (JP) .

* cited by examiner

*Primary Examiner*—Teresa Walberg
*Assistant Examiner*—Leonid Fastovsky
(74) *Attorney, Agent, or Firm*—Sughrue, Mion, Zinn Macpeak & Seas, PLLC

(57) ABSTRACT

A micromachined pump apparatus 1 includes a substrate 2 having upper and lower surfaces and a plurality of lengthwise arranged apertures 2A–2E, each of which has an upper surface opening and a lower surface opening. A plurality of diaphragms 6A–6E close the upper surface openings of the apertures 2A–2E, respectively. A guide plate 3 is fixedly mounted on the upper surface of the substrate 2 and defines a passage 3*a* through which an object fluid is moved by cooperating with the diaphragms on the upper surface of the substrate 2. A base plate 4 is fixedly mounted at its upper surface on the lower surface of the substrate 2, thereby enclosing an operating fluid in each of the apertures 2A–2E. An electrically operated heater device 5 is provided on the upper surface of the base plate 4 for heating the fluids in the apertures 2A–2E, respectively, in such a manner that whenever the fluids are heated the resultant expansion of the respective operating fluid expands the diaphragms, respectively, toward the passage. The expansions of the diaphragms 6A–6E are made in sequence, thereby forcing the object fluid to move through the passage 3*a*.

7 Claims, 5 Drawing Sheets

MICROMACHINED PUMP APPARATUS

BACKGROUND OF THE INVENTION

The present invention is directed to a micromachined pump apparatus having a diaphragm adjacent an internal closed space for the closure thereof which operates in such a manner that whenever the volume of the internal closed space is increased, the diaphragm is deformed or expanded toward a passage, thereby forcing an object fluid to move in the passage.

Miniature pumps, hereinafter referred to as micropumps, can be constructed using fabrication techniques adapted from those applied to integrated circuits. Such fabrication techniques are often referred to as micromachining.

Micromachined pumps or micropumps are disclosed for example in Japanese Patent Laid-open Print No. Hei. 10(1998)-159811 and Japanese Patent Laid-open Print No. Hei. 7(1995)-139471.

In the former, the increase of pressure in the closed space which causes the expansion of the diaphragm is made in such a manner that a light beam is applied to a light/heat converting substance accommodated in the closed space and the resultant heat generation causes the operating fluid in the closed space to expand. However, the light application requires an optical fiber which is not very efficient in transmitting light and an optical transmission mechanism per se is expensive.

In the latter, the diaphragm is expanded by supplying air into the closed space. However, a large pressure loss occurs between a pressure source and the micropump, thereby requiring a relatively large scaled pressure source for effective expansion of the diaphragm.

Accordingly, a need exists for a micromachined pump apparatus without the foregoing drawbacks.

SUMMARY OF THE INVENTION

The present invention has been developed to satisfy the need noted above and thus has for a primary object the provision of a micromachined pump apparatus which comprises a substrate having upper and lower surfaces, the substrate having a plurality of lengthwise arranged apertures each of which has an upper surface opening and a lower surface opening, a plurality of diaphragms closing the upper surface openings of the apertures, respectively, a guide plate fixedly mounted on the upper surface of the substrate and defining a passage through which an object fluid is moved by cooperating with the diaphragms on the upper surface of the substrate, a base plate fixedly mounted at its upper surface on the lower surface of the substrate and enclosing an operating fluid in each of the apertures, and an electrically operated heater device provided on the upper surface of the base plate, the heater device heating the fluids in the apertures, respectively, in such a manner that whenever the operating fluids are heated the resultant expansion of the respective operating fluid expands the diaphragms, respectively, toward the passage, the expansions of the diaphragms being made in sequence, thereby forcing the object fluid to move though the passage.

In accordance with the present invention having the foregoing structure, unlike the conventional devices, the expansion of the enclosed fluid which causes the expansion of the diaphragm is made electrically, which simplifies the structure for the fluid inflation. In addition, the amount of heat on which the degree of expansion of the diaphragm depends can be easily controlled by adjusting the current.

BRIEF DESCRIPTION OF THE DRAWINGS

The above and other objects, features and advantages of the present invention will be more apparent and more readily appreciated from the following detailed description of preferred exemplary embodiments of the present invention, taken in connection with the accompanying drawings, in which.

DETAILED DESCRIPTION OF THE INVENTION

Figure 1:
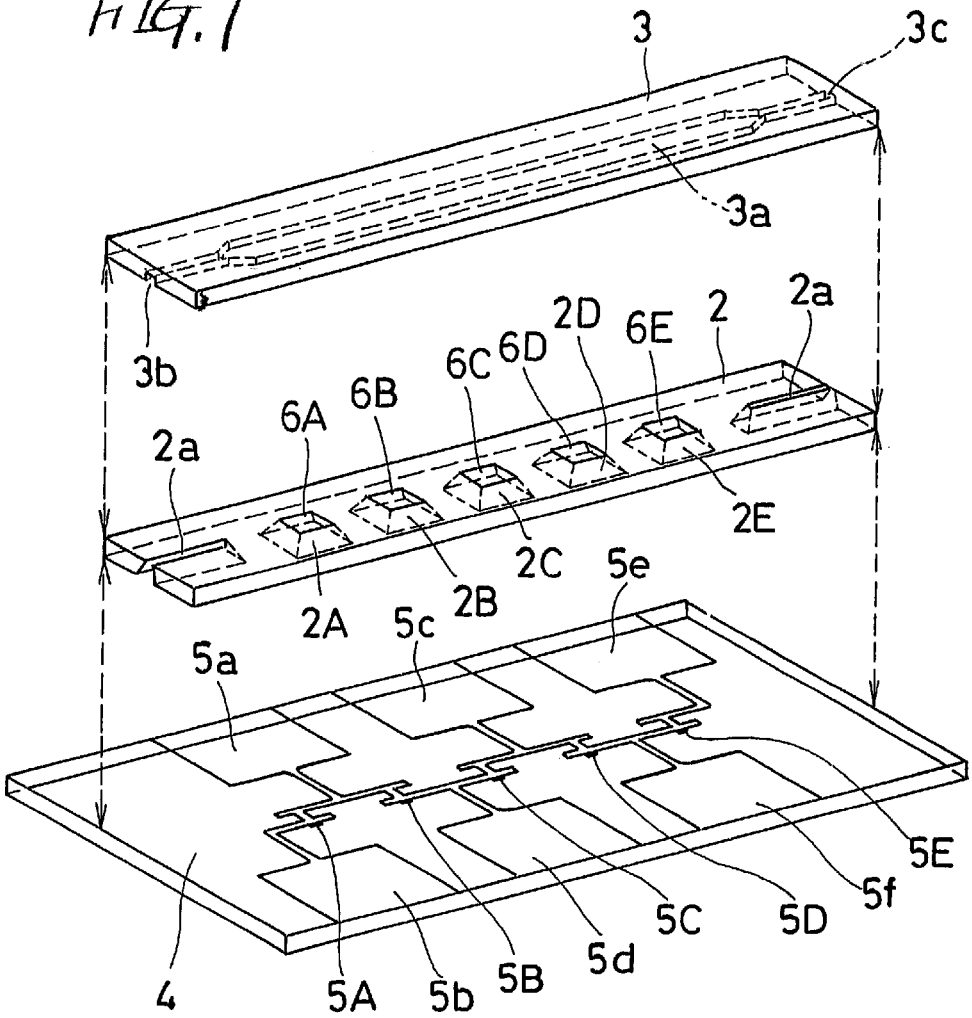
FIG. 1 is an exploded perspective view of a micromachined pump apparatus in accordance with a first embodiment of the present invention.
Figure 2:
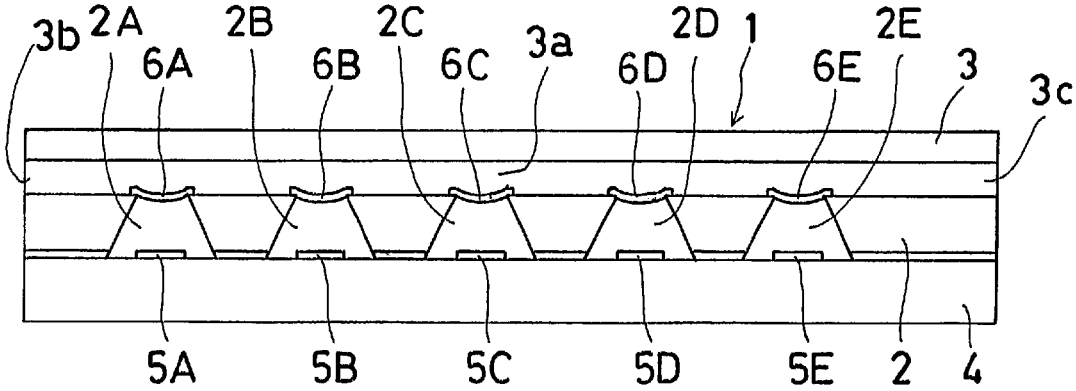
FIG. 2 is a lengthwise cross-sectional view of the micromachined pump apparatus shown in FIG. 1.

Preferred embodiments of the present invention will be described hereinafter in detail with reference to the accompanying drawings.

With reference to FIGS. 1–6, there is illustrated a miniature pump apparatus 1. The miniature pump apparatus 1 is constructed by using fabrication techniques adapted from those applied to integrated circuits. As well known, such fabrication techniques are often referred to as micromachining.

The miniature pump apparatus 1, which is used to force a very small amount of object fluid whose viscosity is relatively low, includes a substrate 2 which is formed with five equi-spaced pass-through apertures 2A, 2B, 2C, 2D, and 2E, five diaphragms 6A, 6B, 6C, 6D, and 6E closing upper openings of the respective apertures 2A, 2B, 2C, 2D, and 2E, a guide plate 3 secured to the upper surface of the substrate 2 is formed with a concave passage 3*a* in the lower surface thereof through which a fluid passes, and a base plate 4 closing the apertures 2A, 2B, 2C, 2D, and 2E from the bottom and provided with five heaters 5A, 5B, 5C, 5D, and 5E for heating the fluids in the respective apertures 2A, 2B, 2C, 2D, and 2E. An operating fluid is provided in each of the apertures 2A, 2B, 2C, 2D, and 2E, before the base plate 4 is coupled to the bottom of the substrate 2.

The substrate 2 is formed of single crystal Silicon and has a thickness of 250 $\mu$m. Each of the apertures is formed into a trapezoid structure by means of anisotropy etching in such a manner that a top side is smaller than a bottom side in area. The top sides of the respective apertures 2A, 2B, 2C, 2D, and 2E are closed in fluid-tight manner by the diaphragms 6A, 6B, 6C, 6D, and 6E, respectively. Thus, each of the apertures 2A, 2B, 2C, 2D, and 2E becomes a closed space.

Each of the diaphragms 6A, 6B, 6C, 6D, and 6E is made in such a manner that one side of an original diaphragm material is formed thereon with an oxidized thin film while the original diaphragm material is kept at a high temperature, and thereafter the other side is provided with a metal thin film while the original diaphragm material is kept at a room temperature so as to establish a difference of thermal expansion rate across the original diaphragm material. Thus, each of the diaphragms 6A, 6B, 6C, 6D, and 6E is bent into a curvature.

The guide plate 3 is formed of glass for easy positioning thereof during assembly. The guide plate 3 is provided at its opposite ends with a first port 3*b* and a second port 3*c* which are in fluid communication with opposite ends of a concave portion 3*a*, respectively. The lateral width of the concave portion 3*a* is identical with that of each of the diaphragms 6A, 6B, 6C, 6D, and 6E. The guide plate 3 has a thickness of 250 $\mu$m. The concave portion 3*a* has a depth of 15 $\mu$m. The guide plate 3 is fixedly mounted by means of a bonding agent on the upper side of the substrate 2 in such a manner that the diaphragms 6A, 6B, 6C, 6D, and 6E are aligned with the concave portion 3*a*.

Similar to the guide plate 3, the base plate 4 is formed of glass for easy positioning thereof when assembled. The base plate 4 is identical with both the substrate 2 and the guide plate 3 in length but is wider than the substrate 2 and the guide plate 3. The base plate 4 has a thickness of 250 $\mu$m.

The miniature pump apparatus 1 is provided with a heater device 5 which includes five heating elements 5A, 5B, 5C, 5D, and 5E which are deposited on the upper surface of the base plate 4 so as to be aligned with the lower sides of the respective apertures 2A, 2B, 2C, 2D, and 2E. The heating elements 5A, 5B, 5C, 5D, and 5E are formed of NiCrSi and have a resistive value ranging from 20 to 100 Ohms. The heater device 5 also includes six terminal elements 5*a*, 5*b*, 5*c*, 5*d*, 5*e*, and 5*f* which serve for connecting between a current supply source or a power source 7 (cf. FIG. 7) and each of the heating elements 5A, 5B, 5C, 5D, and 5E. The terminal elements 5*a*, 5*b*, 5*c*, 5*d*, 5*e*, and 5*f* are formed of Au having a resistive value ranging from 1 to 5 Ohms which is smaller than the resistive value of each heating element. In light of the fact that Au is difficult to adhere directly to glass, six Cr plates are deposited on the base plate 4 and the Au terminal elements 5*a*, 5*b*, 5*c*, 5*d*, 5*e*, and 5*f* are deposited on the Cr plates, respectively, thereby forming the Au terminal elements 5*a*, 5*b*, 5*c*, 5*d*, 5*e*, and 5*f* on the glass base plate 4. The deposition or sputtering of NiCrSi is made for alignment with the lower sides of the respective apertures 2A, 2B, 2C, 2D, and 2E for forming the heating elements 5A, 5B, 5C, 5D, and 5E.

Figure 3:
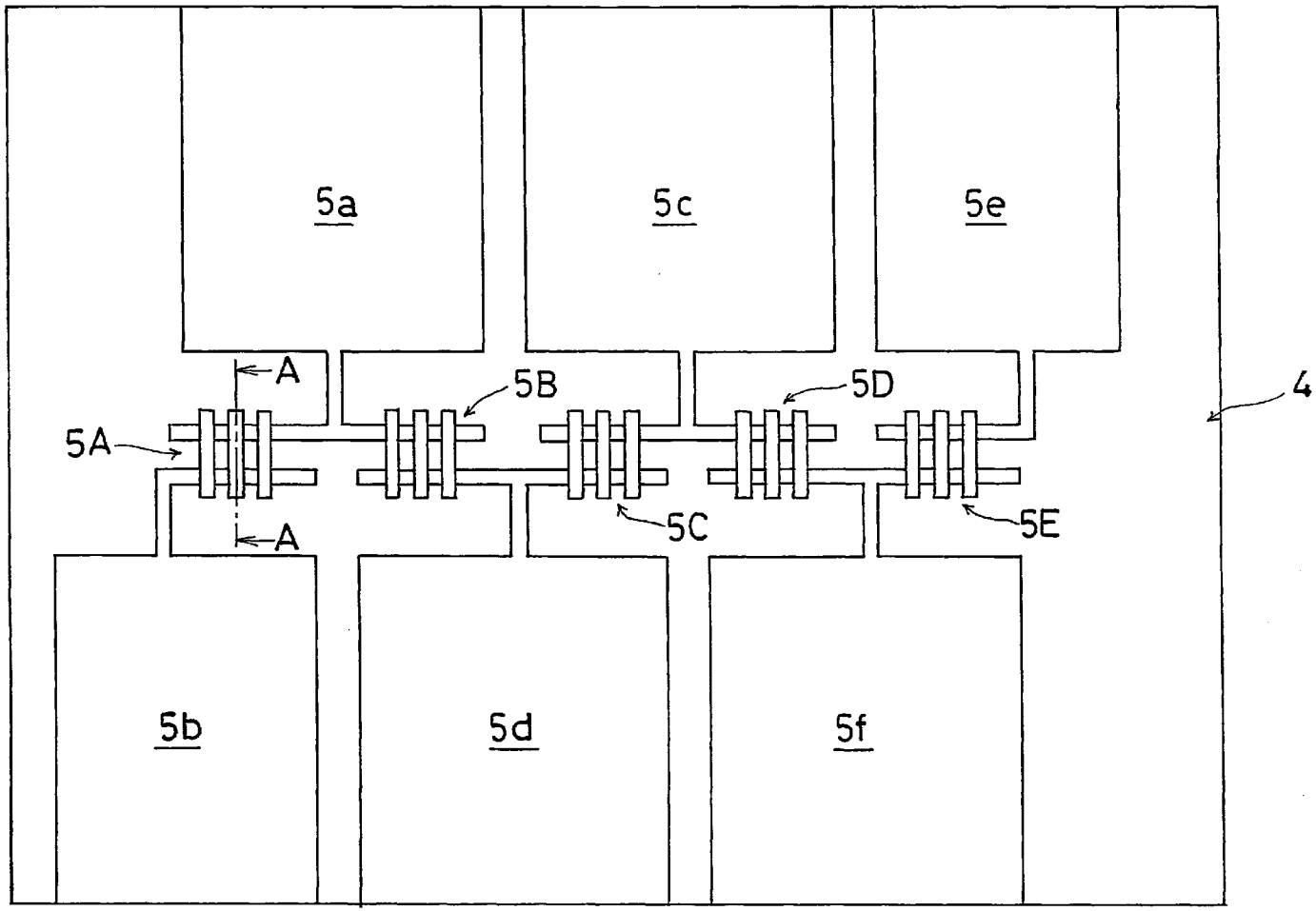
FIG. 3 is a view showing how heaters are positioned in the micromachined pump apparatus shown in FIG. 1.

As best shown in FIG. 3, each of the heating elements 5A, 5B, 5C, 5D, and 5E is divided in to three spaced parallel parts. The parallel-three-part-structured heating element 5A is layered on a distal end of the terminal element 5*a* and a distal end of the terminal element 5*b*, the parallel-three-part-structured heating element 5B is layered on another distal end of the terminal element 5*a* and a distal end of the terminal element 5*d*, the parallel-three-part-structured heating element 5C is layered on a distal end of the terminal element 5*c* and another distal end of the terminal element 5*d*, the parallel-three-part-structured heating element 5D is layered on another distal end of the terminal element 5*c* and a distal end of the terminal element 5*f*, and the parallel-three-part-structured heating element 5E is layered on a distal end of the terminal element 5*e* and another distal end of the terminal element 5*f*.

Figure 4:
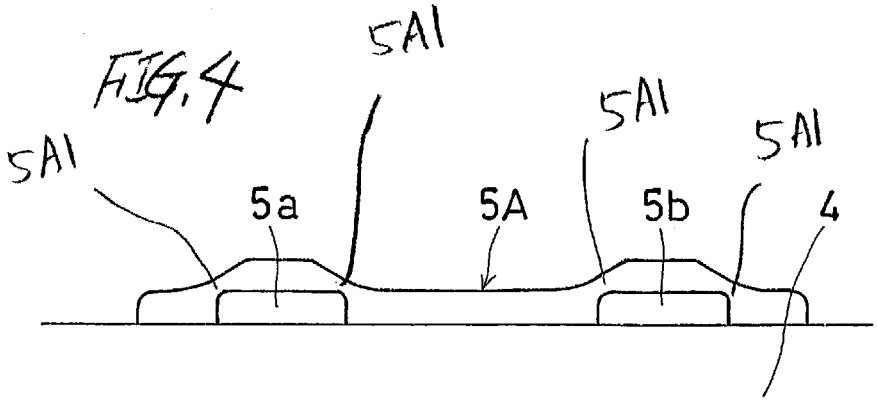
FIG. 4 is a cross-sectional view taken along line A—A in FIG. 3.
Figure 6:
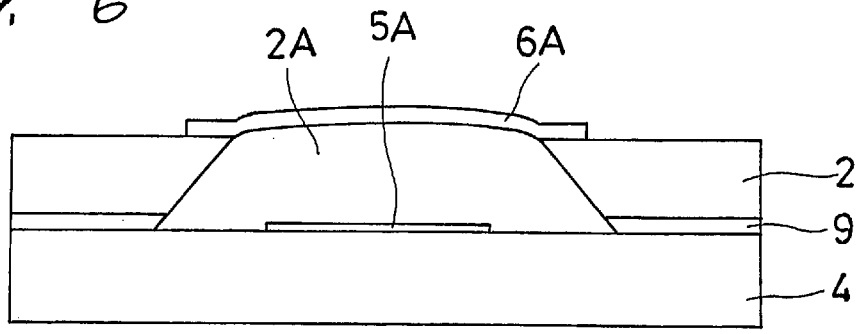
FIG. 6 is an enlarged view showing another mode of the portion shown in FIG. 2.

As best shown in FIG. 4, the thickness of the heating element 5A becomes minimum at positions 5A1 when layered on upper two edge portions of the terminal element 5*a*, while the thickness of the heating element 5A also becomes minimum at positions 5A1 when layered on two upper edge portions of the terminal element 5*b*. Such a structure is found in each of other heating elements 5B, 5C, 5D, and 5E. When a current is applied to the heating element 5A, the resulting amount of heat generation becomes maximum at the portions 5A1. This establishes a quick evaporation of the fluid which is of a low boiling point, thereby shortening the time period duration which the current is supplied to each of the heating elements. Thus, the returning motion of each diaphragm from its expanded position to its original position can be made as quick as possible, which lessens the amount of heat involved in the concave portion 3*a*, and provides a quick responsiveness for the miniature pump apparatus 1. It is to be noted three parts of each of the heating elements 5A, 5B, 5C, 5D, and 5E can be arranged in a curved manner instead of the illustrated straight lined manner.

Figure 7:
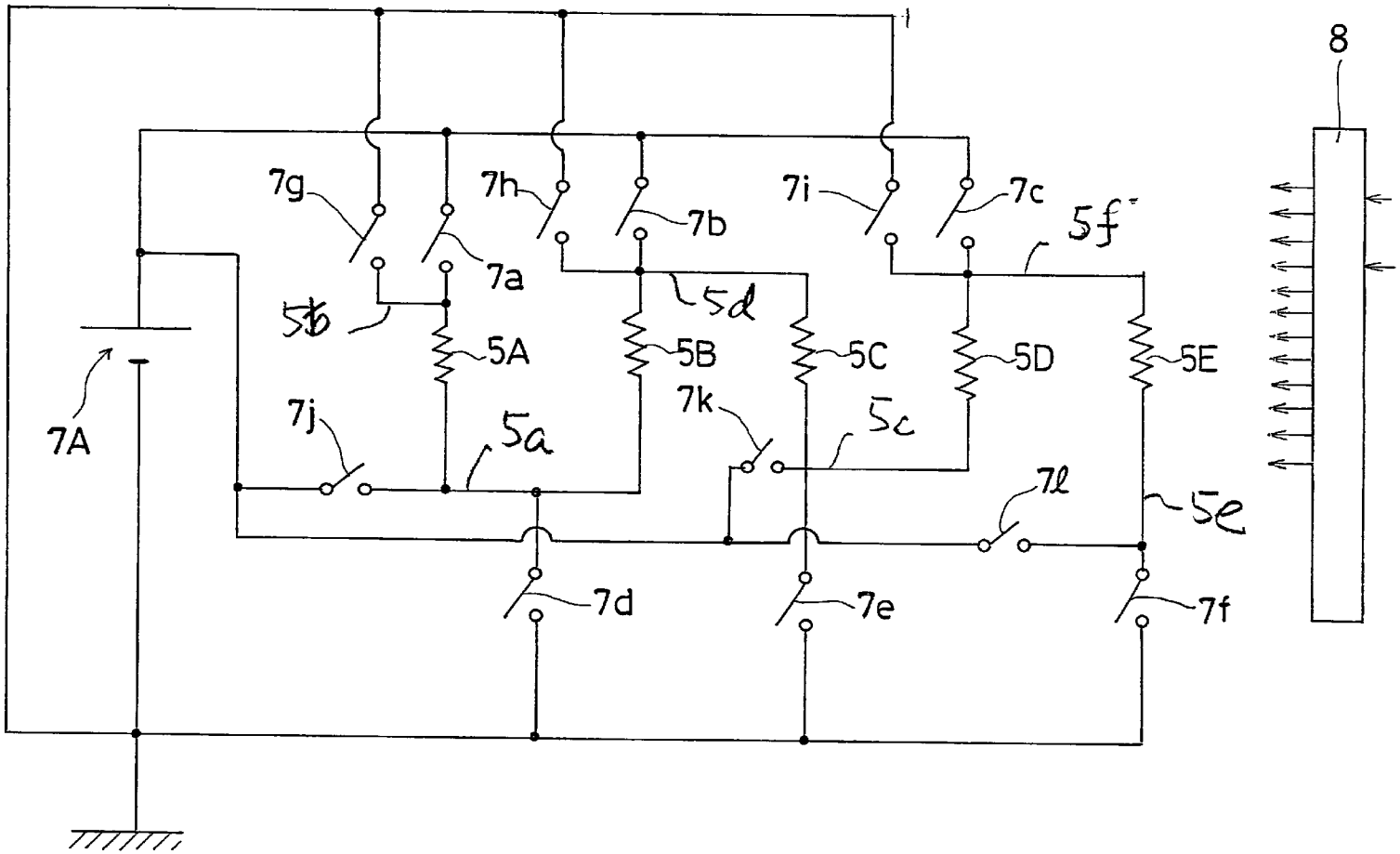
FIG. 7 shows an electric circuit for a heater device employed in the micromachined pump apparatus shown in FIG. 1.

As illustrated in FIG. 7, the current supply source 7 includes a 5-volt battery 7A which is in association with a set of the switches 7*a*, 7*b*, 7*c*, 7*d*, 7*e*, 7*f*, 7*g*, 7*h*, 7*i*, and 7*j* and depending on conditions thereof current supply to each of the heating elements 5A, 5B, 5C, 5D, and 5E is made as will be detailed later. The switches 7*a*, 7*b*, 7*c*, 7*d*, 7*e*, 7*f*, 7*g*, 7*h*, 7*i*, and 7*j* are under the control of a controller 8 which is a CPU or micro-processor. Depending on a desired flow-rate of the fluid and/or a temperature thereof, the controller 8 operates to close one or more switches.

At opposite ends of the substrate 2, there are provided slits 2*a* and 2*a*, respectively, by means of anisotropy etching. The slits 2*a* are used as an inlet and outlet, respectively. The fluid supplied to one slit 2*a* by way of a conduit connected thereto is moved through 3*b*, 3*a*, and 3*c* by the pumping action of the apparatus 1 as will be detailed later and forced out from the other slit 2*a* to another conduit connected thereto.

As explained above, on the upper surface of the base plate 4 there are deposited the heating elements 5A, 5B, 5C, 5D, and 5E. Thus, when the substrate 2 is mounted on the upper surface of the base plate 4, gaps (not indicated) are defined therebetween. However, such gaps are filled with a bonding agent used for coupling the base plate 4 and the substrate 2 subject to the thickness of the bonding agent layer being larger than the thickness of each of the heating elements 5A, 5B, 5C, 5D, and SE. Upon completion of the coupling of the base plate 4 and the substrate 2, in each of the apertures 2A, 2B, 2C, 2D, and 2E, an inner fluid is enclosed in fluid-tight manner.

Figure 5:
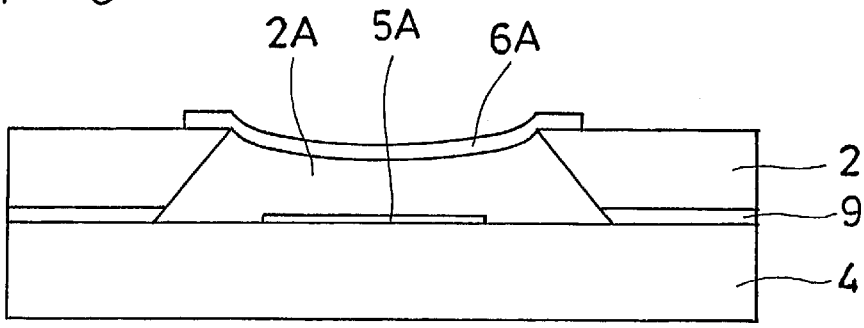
FIG. 5 is an enlarged view of a portion shown in FIG. 2.

The apparatus 1 having the foregoing structure operates as follows. While all the switches are opened if the controller 8 detects a flow rate and the temperature of the fluid, the controller 8 closes the switches 7*a* and 7*d*, thereby applying a current to the heating element 5A and the resultant heat evaporates the fluid having a low boiling point which is enclosed in the aperture 2A. Thus, the diaphragm 6A is brought into an operative or convex condition (FIG. 6) from an assembled or concave condition (FIG. 5). Then, closing the switch 7*h* concurrently with opening the switch 7*d* brings both concave conditions of the diaphragms 6A and 6B. Subsequently, establishing simultaneous closing of the switches 7*e* and 7*j* and opening the switches 7*a* and 7*h* brings current supplies to both the heating elements 5B and 5C, whereby the diagram 6A is returned to the original condition shown in FIG. 5 and simultaneously the diaphragms 6B and 6C are brought into convex conditions, respectively. Thus, similar switching operations can control the convex condition of the diaphragms in sequence in such a manner that two adjacent diaphragms are convex simultaneously which forces the fluid in the passage 3*a* from the inlet port to the outlet port.

It is to be noted that other than the foregoing diaphragm convex mode, other modes can be employed. For example, the diaphragms can be brought into convex condition in turn one by one. In the foregoing structure, despite the use of five heating elements the number of terminals is merely six, thereby simplifying the wiring. Thus, this apparatus 1 can be miniaturized.

Figure 8:
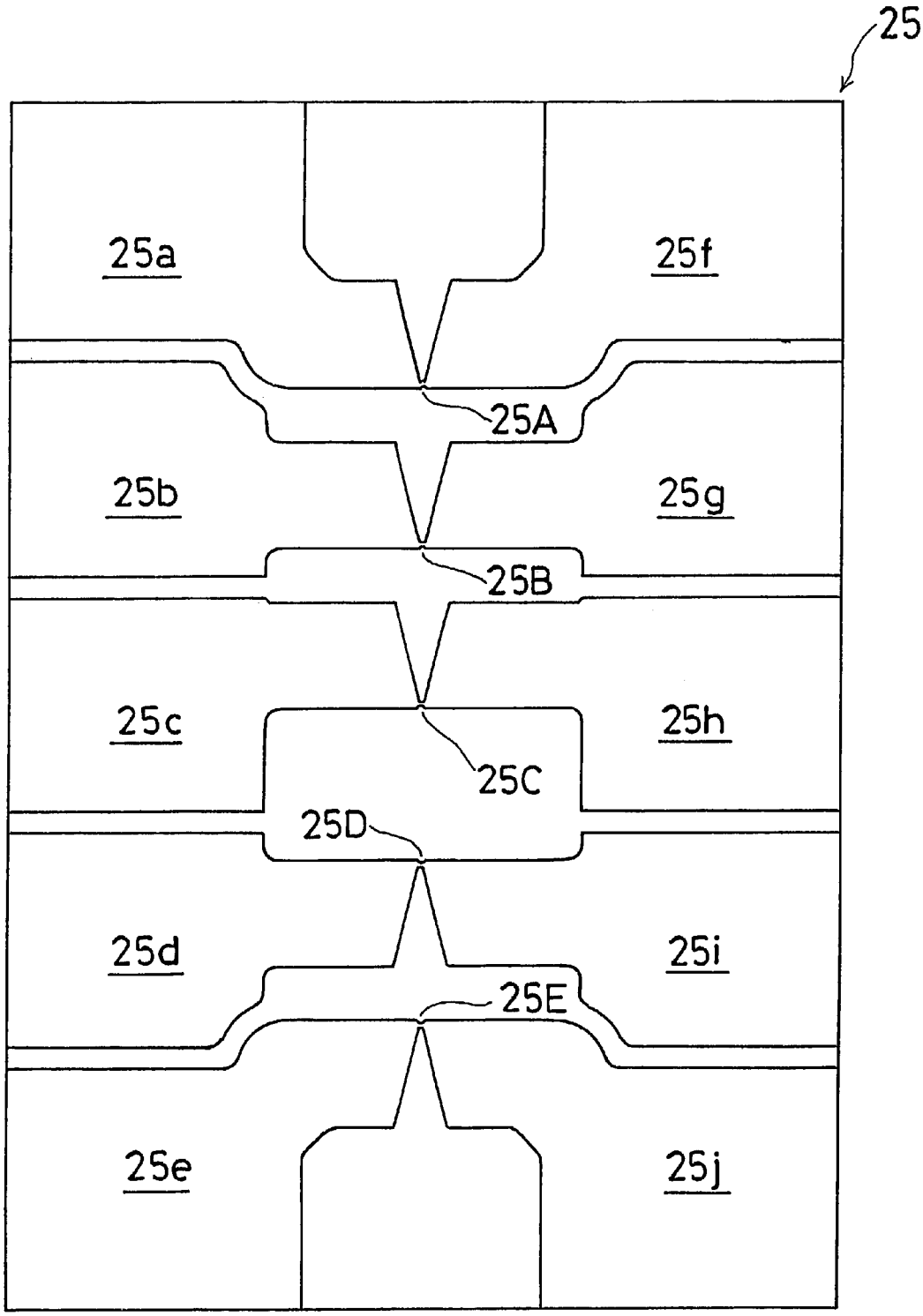
FIG. 8 shows another mode of the heater device.

As shown in FIG. 8, another heater device 25 is illustrated. In this heater device 25, a heating element 25A is formed between terminal elements 25*a* and 25*f* in such a manner that the heating element 25A is formed into a bottlenecked shape for enabling easy heat generation at the heating element 25A. Current supply through the terminal element 25*a*, the heating element 25A, and the terminal element 25*f* brings immediate heat generation at the heating element 25A due to the fact the current passing area is much smaller than that of each of the terminal elements 25*a* and 25*f*.

Heating elements 25B, 25C, 25D, and 25E, which are between terminal elements 25*b* and 25*g*, between terminal elements 25*c* and 25*h*, between the elements 25*d* and 25*i*, and between the elements 25*e* and 25*j* are designed on the basis of the foregoing concept.

Such heat generation at the heating elements 25A, 25B, 25C, 25D, and 25E allows each diaphragm to return from its expanded position to its original position as quickly as possible, which lessens the amount of heat involved in the concave portion 3*a*, and provides for a quick responsiveness of the miniature pump apparatus 1.

The invention has thus been shown and described with reference to specific embodiments. However, it should be understood that the invention is in no way limited to the details of the illustrated structures but changes and modifications may be made without departing from the scope of the appended claims.

What is claimed is:

1. A micromachined pump apparatus comprising;

a substrate having upper and lower surfaces and a plurality of lengthwise arranged apertures each of which has an upper surface opening and a lower surface opening;

a plurality of diaphragms closing the upper surface openings of the apertures, respectively;

a guide plate fixedly mounted on the upper surface of the substrate and defining a passage through which an object fluid is moved by cooperating with the diaphragms on the upper surface of the substrate;

a base plate fixedly mounted at its upper surface on the lower surface of the substrate and enclosing an operating fluid in each of the apertures; and an electrically operated heater device provided on an upper surface of the base plate, the heater device heating the fluids in the apertures, respectively, in such a manner that whenever the operating fluids are heated the resultant expansion of the respective operating fluid expands the diaphragms, respectively, toward the passage, the expansions of the diaphragms being made in turn, thereby forcing the object fluid to move though the passage.

2. A micromachined pump apparatus as set forth in claim 2, wherein the heater device includes a plurality of heater members each of which is in the form of a resistive element and each of which is deposited on the upper surface of the base plate, an electric current source for supplying an electric current, and a controller for controlling an amount of current supplied from the electric current source to each of the heater members.

3. A micromachined pump apparatus as set forth in claim 2, wherein each of the heater members includes a heating element having a resistive element and a pair of terminal elements having resistive values less than a resistive value of the heating element, connected to opposite ends of heating element, respectively, and connected to the electric current source.

4. A micromachined pump apparatus as set forth in claim 3, wherein each of the heating elements differs from each of the terminal elements in raw material.

5. A micromachined pump apparatus as set forth in claim 3, wherein each heating element has a current pass-through area which is identical with each of the terminal elements having current pass-through areas, respectively, in raw material and the current pass-through area of each heating element is smaller relative to that of each of the terminal elements.

6. A micromachined pump apparatus as set forth in claim 5, wherein the heating element is in the form of bottlenecked structure relative to the terminal elements.

7. A micromachined pump apparatus as set forth in claim 2, wherein the substrate and the base plate are coupled to each other for closing the apertures by means of a bonding agent whose thickness is not less than that of each of the resistive heating elements.

* * * * *